US012042003B2

(12) United States Patent
Engell

(10) Patent No.: US 12,042,003 B2
(45) Date of Patent: Jul. 23, 2024

(54) SHOE WITH SOLE PROVIDING A DYNAMIC SUPPORTING HEEL

(71) Applicant: GAITLINE AS, Oslo (NO)

(72) Inventor: Håvard Engell, Oslo (NO)

(73) Assignee: GAITLINE AS, Oslo (NO)

( * ) Notice: Subject to any disclaimer, the term of this patent is extended or adjusted under 35 U.S.C. 154(b) by 127 days.

(21) Appl. No.: 17/781,414

(22) PCT Filed: Nov. 13, 2020

(86) PCT No.: PCT/NO2020/050278
§ 371 (c)(1),
(2) Date: Jun. 1, 2022

(87) PCT Pub. No.: WO2021/112682
PCT Pub. Date: Jun. 10, 2021

(65) Prior Publication Data

US 2023/0011311 A1 Jan. 12, 2023

(30) Foreign Application Priority Data

Dec. 6, 2019 (NO) ..... 20191441

(51) Int. Cl.
*A43B 13/12* (2006.01)
*A43B 13/37* (2006.01)
*A43B 13/41* (2006.01)

(52) U.S. Cl.
CPC ..... *A43B 13/127* (2013.01); *A43B 13/37* (2013.01); *A43B 13/41* (2013.01)

(58) Field of Classification Search
CPC ..... A43B 13/127; A43B 13/125; A43B 13/37; A43B 13/41; A43B 13/145
See application file for complete search history.

(56) References Cited

U.S. PATENT DOCUMENTS 4,241,523 A 12/1980 Daswick
4,348,821 A 9/1982 Daswick
(Continued)

FOREIGN PATENT DOCUMENTS

EP 2747592 B1 11/2018
KR 100807362 B1 * 3/2008
WO WO-2009010078 A1 1/2009

OTHER PUBLICATIONS

Rustad, Hege; International Search Report; PCT/NO2020/050278; dated Jan. 28, 2021; 3 pages.
(Continued)

*Primary Examiner* — Ted Kavanaugh
(74) *Attorney, Agent, or Firm* — Bradley Arant Boult Cummings LLP

(57) ABSTRACT

The invention provides a shoe with a sole providing a dynamic heel support, the shoe comprising a rubber outsole, a midsole comprising a harder elastic material, a softer elastic material, and at least one insert having a higher elastic hardness than the harder elastic material and the softer elastic material, and a higher resistance against bending, wherein the harder elastic material has elastic hardness in a range 1.3 to 3 times higher than the softer elastic material. The shoe is is distinguished in that the harder elastic material is arranged in a band inside the periphery along the sides and heel of the midsole, wherein the softer elastic material is arranged in the midsole inside the band of the harder elastic material, wherein the at least one insert is arranged within the softer elastic material, at least in the heel part of the midsole, and wherein the thickness of the softer elastic material above the insert in the heel part of the midsole is at least 0.5 times the thickness of the insert and the thickness of the softer elastic material below the insert in the heel part of the midsole is at least 1 times the thickness
(Continued)

of the insert as measured at a centreline of the insert, excluding the thickness of any ribs on the inlay.

17 Claims, 5 Drawing Sheets

(56) References Cited

U.S. PATENT DOCUMENTS

| | | | | |
|---|---|---|---|---|
| 4,399,620 | A | 8/1983 | Funck | |
| 4,439,937 | A * | 4/1984 | Daswick | A43B 13/10 36/72 A |
| 5,141,578 | A | 8/1992 | Yang | |
| 5,185,943 | A * | 2/1993 | Tong | A43B 13/184 36/35 R |
| 5,579,591 | A | 12/1996 | Kousaka et al. | |
| 6,119,373 | A * | 9/2000 | Gebhard | A43B 7/144 36/31 |
| 7,200,955 | B2 | 4/2007 | Foxen | |
| 7,421,808 | B2 * | 9/2008 | Baier | A43B 13/026 36/107 |
| 8,196,316 | B2 * | 6/2012 | Cook | A43B 13/141 36/102 |
| 8,448,352 | B2 * | 5/2013 | Ryu | A43B 7/24 36/142 |
| 8,959,798 | B2 | 2/2015 | Pfister | |
| 2005/0034328 | A1 * | 2/2005 | Geer | A43B 3/0052 36/31 |
| 2006/0137228 | A1 | 6/2006 | Kubo et al. | |
| 2007/0107258 | A1 | 5/2007 | Umezawa et al. | |
| 2008/0127515 | A1 | 6/2008 | Lohrer | |
| 2009/0183393 | A1 * | 7/2009 | Lee | A43B 21/28 36/43 |
| 2010/0192416 | A1 | 8/2010 | Rees | |
| 2011/0185590 | A1 | 8/2011 | Nishiwaki et al. | |
| 2014/0059883 | A1 | 3/2014 | Adeagbo et al. | |
| 2018/0027923 | A1 | 2/2018 | Iuchi et al. | |
| 2018/0199665 | A1 | 7/2018 | Luedecke et al. | |
| 2021/0267306 | A1 * | 9/2021 | Sakaguchi | A43B 7/1445 |
| 2023/0011311 | A1 | 1/2023 | Engell | |
| 2023/0309647 | A1 | 10/2023 | Archuleta | |

OTHER PUBLICATIONS

Rustad, Hege; International Search Report; PCT/NO2020/050279; dated Jan. 29, 2021; 3 pages.

Engell, Håvard; "Shoe With Sole Providing a Dynamic Foot Arch Support"; U.S. Appl. No. 17/781,420; filed Jun. 1, 2022; 38 pages.

* cited by examiner

SHOE WITH SOLE PROVIDING A DYNAMIC SUPPORTING HEEL

TECHNICAL FIELD

The present invention relates to shoes. More specifically, the invention provides a shoe with a sole providing a dynamic and comfortable heel support.

BACKGROUND ART

Shoes in many variations have been used for thousands of years. In the modern world, where people mostly walk on hard flat surfaces, various problems related to the foot are widespread. Good shoes can mitigate many of the problems. A traditional walking shoe for healthy feet and healthy guiding of force from the underlayer up into the bones, joints, muscles and connective tissue will typically have a hard sole. Often more than 50% of the sole thickness will be made by rigid, non-elastic material. A different shoe design, probably the state-of-the-art design for mitigating general gait related biomechanical issues, is described and illustrated in the European patent specification EP 2 747 592 B1. In patent publication WO 2009/010078 A1, a molded sole with anatomical foot support bed is described and illustrated. In patent publication US 2018/0199665 A1 footwear including lightweight sole structure comprising a plurality of layered structures for providing enhanced comfort, flexibility and performance features are described and illustrated.

Despite numerous shoe designs and insole designs, a demand still exists for alternative or improved shoe designs.

SUMMARY OF INVENTION

The invention provides a shoe with a sole providing a dynamic heel support, the shoe comprising a rubber outsole. The rubber outsole is alternatively termed undersole or outsole rubber. The shoe further comprises:

a midsole, comprising a harder elastic material, a softer elastic material, and at least one insert having a higher elastic hardness than the harder elastic material and the softer elastic material, and a higher resistance against bending, wherein the harder elastic material has elastic hardness in a range 1.3 to 3 times higher, preferably 1.5-2.5 times higher, than the softer elastic material.

The shoe is is distinguished in that the harder elastic material is arranged in a band inside the periphery along the sides and heel of the midsole, preferably the band extends in a range of 0.1 to 1 times the midsole thickness inwards from the periphery, preferably the band, in the heel part of the midsole is wider, preferably 1.5 to 4 or 1.5 to 3 or 2 to 3 or 2.5 to 3 times wider, on the medial side compared to the lateral side, wherein the softer elastic material is arranged in the midsole inside the band of the harder elastic material, wherein the at least one insert is arranged within the softer elastic material, at least in the heel part of the midsole, and wherein the thickness of the softer elastic material above the insert in the heel part of the midsole is at least 0.5 or 0.8 or 1 or 1.5 times the thickness of the insert and the thickness of the softer elastic material below the insert in the heel part of the midsole is at least 1, 1.5, 2, or 2.5 times the thickness of the insert as measured at a centreline of the insert, excluding the thickness of any ribs on the inlay.

As mentioned, prior art patent publication US 2018/0199665 A1 includes description and illustrations of footwear including a lightweight sole structure comprising a plurality of layered structures. Evident from FIGS. 1 and 12A-12H and described in paragraphs [0031] and [0036], the harder elastic material 160 is arranged below the softer elastic material 130, with flexure plate 150 and strobel member 140 in between. Said strobel member 140 secures the upper to the sole structure, closing for direct contact between said layers 130 and 160. As seen on FIGS. 12A-H of US 2018/0199665 A1, said softer material 130 is on top of the layers of materials 160, 150 and 140 and extends up to elevation far above said harder material 160, as seen with the shoe standing on a horizontal underlayer.

In contrast, obligatory for the shoe of the invention is harder elastic material arranged in a band inside the periphery along the sides and heel of the midsole and softer elastic material arranged in the midsole inside the band of the harder elastic material in the sides and heel of the midsole. There is no material between the softer and the harder elastic material, said materials are directly adjacent and in contact, without other material in between. In the shoe of the invention, the harder elastic material extends to elevation above the softer elastic material as seen with the shoe standing on a horizontal underlayer. In the shoe of the invention, the side support is to a larger extent by having harder elastic material just inside the periphery of the midsole heel and sides, while in the shoe of US 2018/0199665 A1 side support is to a larger extent by building up volume of softer elastic material on the sides of the foot of the user. In the shoe of the invention, the at least one insert, typically a shank, is embedded within the softer elastic material, alternatively is arranged between layers of the softer elastic material, at least in the heel part of the midsole, preferably also in the midfoot and forefoot, the insert is not a flexure plate 150 as defined in US 2018/0199665 A1. In the shoe of the invention, the band of harder elastic material is also in the forefoot but said band can be wider than in the heel and midfoot.

Elastic hardness is measured according to ASTM D2240.

For the harder and the softer elastic material, scale A is used, resulting in Shore A values for elastic hardness. For the insert, Scale A or Scale D is used, resulting in Shore A values or Shore D values for elastic hardness, respectively. The Shore hardness relates to Youngs's modulus of elasticity by relations assumed to be known for the skilled person. The relation is non-linear, and is easiest to find using diagrams, tables or formulas. Youngs's modulus of elasticity relates to resistance against bending, as known according to common general knowledge.

The feature that the harder elastic material has elastic hardness is in a range 1.3 to 3 times higher than the softer elastic material, relates to Shore A values. For example, if the softer elastic material has hardness Shore A of 30, the harder elastic material has Shore A hardness in a range from 39 to 90. The at least one insert has a higher elastic stiffness and bending stiffness than the harder elastic material, preferably Shore D 70-90, more preferably about Shore D 80-85.

The feature that the at least one insert is arranged within the softer elastic material, means moulded or embedded otherwise into the softer elastic material, or arranged between layers of the softer elastic material.

The shoe preferably comprises an inlay sole, arranged on top of the midsole. However, the shoe can be without an inlay sole. The shoe can be a sandal.

The term midsole means the sole over the undersole, with or without an inlay sole or insole on top.

The heel or heel part of the shoe or midsole extends from the rear of the shoe or midsole to under the front part of the heel bone, the calcaneus, of a user with a foot size that fits the shoe size.

The term measured at a centerline of a structure, means measuring the center of the structure along a medial-lateral cross section.

The shoe of the invention preferably comprises a sole or midsole with more than 50%, 60% or 75% relative soft elastic material through the thickness in the heel region, in the form of the harder elastic material and the softer elastic material. Preferably, in the heel region of the sole or midsole the softer elastic material comprises more than 50% or 60% of the thickness of the midsole, arranged below the insert.

The harder elastic material is preferably arranged not only around the softer elastic material, as a band laterally around the softer elastic material, but also in a layer below the softer elastic material. The harder elastic material thereby preferably is arranged as a sole shaped "cup", into which cup the softer elastic material and the insert is arranged, for example by molding.

The structure of the shoe provides a combination of comfort and dynamic control, however, the shoe can be constructed for specific purposes. Most people, typically about 70% of the people, will require a shoe for a calcaneus valgus foot, wherein the midsole is designed to guide force laterally in the heel. Some people will require a neutral shoe, while others will require a shoe with midsole designed to guide force medially in the heel. How the shoe, and particularly the midsole thereof, shall be designed and built, and why, will be clear from the further description below.

The precision in how the shoe can be designed and built for specific effect while retaining comfort, is one reason why the shoe is described as having a dynamic heel support.

A progressive yet comfortable heel support is achieved by combining softer elastic material with harder elastic material and more rigid material, as described and claimed.

The elasticity when compressing the sole initially is soft, guided by the elasticity of the softer elastic material. At further compression, the sole area under the heel, and optionally at other areas, becomes relative more rigid, like a progressive spring. The result is that the more supported part of the heel area, relative to the supported weight per area (stress), sink less down than the other areas. The effect varies according to how much the sole already has been compressed, thereby the heel support is dynamic. An alternative description is a sole with progressive or progressive non-linear elasticity.

Preferably, the at least one insert comprises an inlay in the heel or in the heel and intermediate part of the midsole, the inlay comprising at least one of the features as follows, in any combination:

at least 10% thicker on the medial side than the lateral side, and/or at least 10% stiffer on the medial side than the lateral side, and/or twisted so as to be at higher elevation on the medial side than the lateral side, and/or arranged asymmetrical, to the medial side of the softer elastic material.

Preferably, the insert comprises an inlay in the heel area of the midsole, preferably also covering the midfoot area or arch of the midsole, in which case the insert is a shank. The inlay preferably is twisted in clockwise direction for a right foot midsole as seen from behind, in the heel area, at an angle $\alpha 2$ in a range 1° to 10°, more preferably 2° to 10°, or 2° to 7° from horizontal. Preferably, the inlay comprises longitudinal ribs along the underside, the ribs are preferably higher on a medial side than on a lateral side. Preferably, at maximum extension the ribs extend out from the inlay underside at least a distance equal to the thickness of the inlay without said ribs. Preferably the inlay, exclusive any ribs, is 0.5-5 mm, or 0.5-3 mm or 1-3 mm or 1-2.5 mm thick.

The insert, be it an inlay or a shank, is preferably made of a polymer material, preferably polyamide, preferably PA6 or PA66. Other polymers, such as, PE or PET can be used, or carbon fibre or carbon composites, or metal. One or more of thickness, shape, width, slits and ribs are preferably adapted to provide an inlay or shank having similar bending stiffness or elastic hardness as for PA6 or PA66 inlay or shank in dimensions as described, if material with different mechanical properties are used. The described dimensions for inlay or shank of PA6 or PA66 is for a shoe of size 39.

With different dimension of the shoe, all dimensions described are preferably adjusted proportionally.

Preferably, the at least one insert is a shank, the shank is embedded in the intermediate sole from the heel to the forefoot of the intermediate sole, in the softer elastic material, extending over 60-95% of a last length and extending 60-95% over the last width.

Preferably, the shank is twisted in clockwise direction for a right foot midsole as seen from behind, from the heel to an intermediate part to a position in front of the navicular bone of a user, the twisting is at an angle $\alpha 2$ in a range 1° to 10°, more preferably 2° to 10°, or 2° to 7° from horizontal. The part of the shank extending forwards in the midsole, from 0-4 cm in front of the os naviculare bone as vertically projected to under the forefoot, is preferably in substance horizontal.

Preferably, the shank comprises longitudinal ribs along the shank underside, the ribs extending from the heel and intermediate part to a position in front of the navicular bone of a user, the ribs are higher on a medial side of the shank compared to on a lateral side of the shank, at maximum extension the ribs extend out from the shank underside at least a distance equal to the thickness of the shank without said ribs.

Most preferably, the insert, be it a shank or an inlay, is made of polyamide, preferably PA6 or PA66, preferably the insert, exclusive any ribs, is 0.5-5 mm or 0.5-3 mm or 1-3 mm thick and 20-45 mm wide in medial to lateral direction in the heel area of the midsole, such as vertically below the centre of the heel bone of a user with feet fitting the shoe size or at a medial-lateral center position.

The midsole preferably comprises polyurethane as the harder elastic material, preferably polyurethane—PU—in a Shore A hardness range 40-80, more preferably Shore A about 60, and a polyurethane as the softer elastic material, preferably polyurethane—PU—in a Shore A hardness range 20-60, more preferably Shore A about 30.

Preferably, at least a part of the midsole top surface is inclined, wherein the midsole is higher on the medial side than on the lateral side in the heel and intermediate part to a position in front of the navicular bone of a user. Preferably, the inclination is at an angle $\alpha 1$ in a range 1° to 7° from horizontal. The forefoot part of the midsole top surface preferably is in substance horizontal, in medial-lateral direction.

With reference to the inlay or shank rotation $\alpha 2$, and the midsole top surface inclination $\alpha 1$, preferably $\alpha 2 \geq \alpha 1$, more preferably $\alpha 2 > \alpha 1$.

Preferably, the thickness of the softer elastic material over the support structure/shank in the midfoot area of the midsole is lower than the thickness of the softer elastic material over the support structure in the heel area of the midsole. This provides a soft elasticity at initial compression by the foot of the user, but a progressively harder elastic support in the midfoot area of the shoe than in the heel area at further compression, with harder elasticity starting at less compression in the midfoot area compared to the heel area of the midsole, and more expressed on the medial side compared to lateral side.

The terms heel part, heel region, heel area, means the rear part of the shoe and sole, under the heel of a typical user fitting the shoe size.

Below a bone structure, such as the calcaneus bone or the navicular bone, means vertically below the centre of the specified bone of a typical user with feet fitting the shoe size, unless otherwise specified.

For left shoes, the definitions with respect to twisting is reversed, as obvious for the skilled person in the art.

The shoes of the invention also include specialized embodiments, such as shoes for persons suffering from diabetes, shoes for small children and shoes for running.

Of particular relevance for persons with diabetes is that the shoe of the invention provides enhanced dynamic weight distribution on the foot, by several features of the shoe. The effect of harder elastic material arranged as a band inside the sides and heel of the midsole rather than larger volumes of softer elastic material, is one feature. Inherent guiding of the resultant force of the user to guide a centre of gravity of the foot of the user during a gait to follow a line vertical below the mass or volume centre of the bone structure along the foot, by the outward twisted heel sole and shank/insert and by the midfoot arch support, are further features. The inherent dynamic elasticity, as described explicitly elsewhere, is also a feature. A convex sole in longitudinal direction combined with a concave or flat sole in transverse direction against a flat underlayer, is an additional feature. The result is a semi-unstable shoe by which extreme partial pressure concentrations are avoided and the brain is assumed to receive enhanced continuous signals from the sensory system. The blood circulation is assumed to be enhanced. As a specific example, when standing in a position in balance, the centre of gravity is not static and the foot is not static, sine the sensory system (nerves) detects small deviations in load and stress in the foot tissue, providing signals for adjusting the position of the foot and body, to stay in a balance position by very fast and accurate, often non-conscious, adjustments, often referred to as postural pendulum. The result is a dynamic process of pressure variation on the foot and thereby stimuli for circulation, including the soft tissue of the midfoot. Said process is not masked by large volumes of soft material supporting the foot but enhanced by the structural design of the shoe. For a person with diabetes in an early stage, with feet without significant deep tissue injury, the basic shoe embodiment as defined in the independent claim, and including archroller and shank, may be an optimal shoe.

For persons with diabetes with significant inflammation and/or damages to the deep tissue of the feet, the shoe preferably includes one or more of the features as follows, in any combination:

increased horizontal dimension of the shoe across the shoe in medial-lateral direction, by 2%, 3%, 5%, 8%, 10% or 15% or above, increased vertical dimension of the shoe between sole and upper, by 2%, 3%, 5%, 8%, 10% or 15% or above, structural modification for decreasing the contact pressure on the tissue below the toe ball of the first toe (the big toe) of a user with feet fitting the shoe size, by decreasing elastic hardness and/or lower elevation or height or thickness of the sole in an area under the toe ball of the first toe of the user compared to the area around, preferably under the centre point of the toe ball of the first toe of the user or the centre point of the affected tissue and at least 0.5 cm around said centre point, such as 0.5; 1 or 1.5 or 2 or 3 cm around said centre point, and optionally likewise under any of the further metatarsal heads/toe balls, and/or adding a pelotte underneath the metatarsal bones, wherein the contact pressure under the first toe ball of the user is reduced by shifting some of the load to other parts of the forefoot, and structural modification for decreasing the contact pressure on the tissue below the heel bone of a user with feet fitting the shoe size, by decreasing elastic hardness and/or lower elevation or height or thickness of the sole in an area under the heel bone of the user compared to the area around, as for instance underneath the medial heelbone area (for calcaneus valgus) compared to an optimal, wider pressure distribution underneath the total plantar area of the heel bone. In a preferable embodiment the sole is adjusted under the centre point of the heel bone or the centre point of the affected tissue of the user and at least 1 or 1.5 or 2 or 2.5 or 3 or 4 cm around said point. In addition to the reduced pressure under the heelbone, the dynamic loading of the midfoot area will contribute to further reduction of elastic hardness underneath the heelbone.

The features of increased dimension are adjustments with respect to varying degrees of inflammation. For example, the dimensions are adjusted as compared to European shoe size standard size 39 (ISO/TS 19407:2015, EU or EUR). For other sizes or standards dimensions can be adjusted proportionally.

The structural modification(s) for decreasing the contact pressure, are for adjusting the shoe to reduce contact pressure on typical areas of damage bothering persons with diabetes, as underneath the heelbone and first metatarsal head. A midsole height reduction of at least 0.5 mm, or 1 mm or 2 mm, and/or reduction in elastic stiffness by at least 5, 10 or 15 Shore A units by using softer elastic material in the specified areas under the toe ball of the first toe and/or under the heel bone, and/or modifying a shank to include an opening below the toe ball of the first toe and/or the heel bone, will help. Likewise, sole adjustments under the centre point of any affected deep tissue area of a foot of a user are further embodiments of the shoe of the invention.

The physical effects of said adjustments of the shoes are in principle known or predictable by logical reasoning and/or calculations/simulations and/or measurements, but the clinical effect for persons with diabetes cannot be verified until comprehensive scientific testing has taken place. Even though the shoes may help many persons, individual following up and adaptations should always be the rule for persons seriously affected by deep tissue damage caused directly or indirectly by diabetes.

Children shoes, for the very smallest sizes, for example European size 20 and 21, must not necessarily include all obligatory distinguishing features as specified in the characterizing clause of claim 1 as filed. An archroller will however always be present, and a moderately thicker or higher sole medially than laterally, at least in the heel and midfoot area of the sole.

A further embodiment of a shoe of the invention is shoes for running. Running shoes are preferably lighter, preferably by using lighter material, such as a lighter material than standard PU in the midsole. For example, PU strengthened by carbon fibres, such as nano carbon fibres, can be feasible, since the elastic stiffness of a lighter PU grade can be increased with moderate weight increase. Other examples are block copolymers, for example of polyether and polyamide. For a running shoe, the midsole is preferably 5-50% thicker, more preferably 10-30% thicker compared to a standard shoe for walking. The sole thickness is preferably mainly by increased thickness of the softer and the harder elastic material. In addition, the heel region of the sole of the running shoe is preferably relative higher compared to the intermediate and forefoot areas of the sole, compared to a standard shoe for walking, preferably 5-30% higher, wherein the sole is higher in at least the heel region. Preferably, both the heel region and the forefoot region of the sole is thicker compared to a standard shoe for walking, preferably also the "forefoot drop", i.e. the heel thickness minus the forefoot thickness of the sole, is increased. This means that both the heel region and the forefoot region of the sole has increased thickness, preferably also the midfoot region, but preferably with larger increase in thickness in the heel region of the sole. For example, for a typical running shoe of the invention, the heel part of the sole has increased thickness compared to the forefoot part of the sole such as measured under the heel bone centre compared to under the toe ball centre of the first toe of a typical user with feet having size matching the shoe size, for example the thickness difference may increase from 7 or 9 mm to 10 or 11 mm for a size 39 shoe. Such adjustments are within the scope of protection of the independent claim as filed.

DETAILED DESCRIPTION OF THE INVENTION

Figure 1:
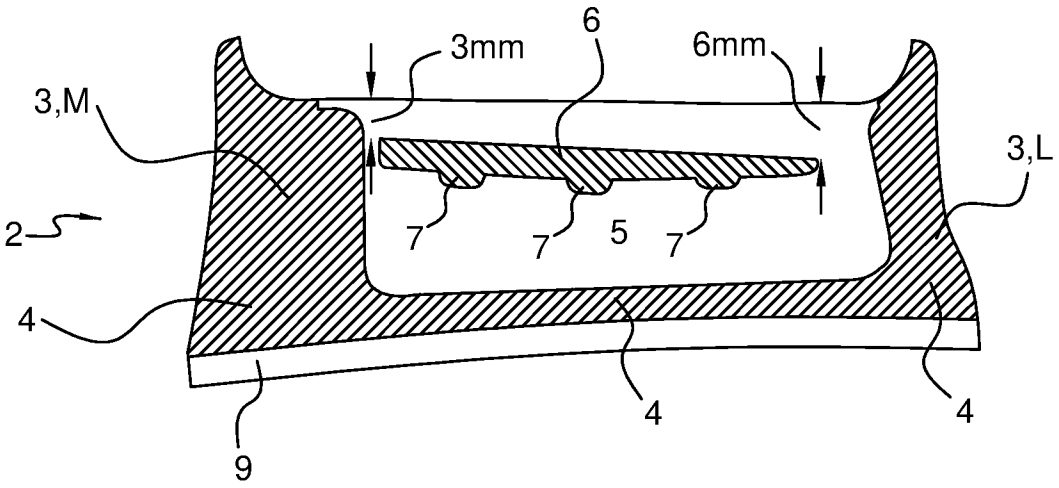
FIG. 1 is a medial-lateral cross section through the heel region of a midsole of a shoe of the invention.

Reference is made to FIG. 1, illustrating a cross section medial to lateral of the heel region of a midsole 2 with rubber outsole 9 of a shoe 1 of the invention, for a right shoe midsole as seen from behind. A band 3 of the harder elastic material 4 extends inwards around the periphery of the midsole. As clearly seen, the band 3 is wider on the medial side M than on the lateral side L. The harder elastic material is also arranged on the lower part of the midsole, which lower part is attached to the rubber outsole. In the midsole, the softer elastic material 5 fills the midsole inside the band and over the lower part. Within the softer elastic material, an insert 6 in the form of an inlay or a shank can clearly be seen in cross section. If the insert is a shank, it extends further forwards in the midsole than an inlay.

It can be seen clearly, if the rubber outsole 9 is positioned on a horizontal surface, that the insert is turned clockwise, and that the top surface of the heel part of the midsole, the in substance even or flat parts thereof, excluding rims and edges, is inclined clockwise. The thickness of the softer elastic material over the medial side of the insert is 3 mm, while the thickness of the softer elastic material over the lateral side of the insert is 6 mm, in the illustrated embodiment, at the chosen location for the cross-section. The cross-section location is vertically below a center of the cuboid of a typical user. Measured at a center or centerline of the insert, the thickness of the softer elastic material over the insert is 4.5 mm. Compared to the horizontal, parallel with the underside of the midsole, it can be seen clearly that the insert is twisted clockwise more than the top surface of the midsole is inclined clockwise.

The insert is thicker on the medial side than on the lateral side, about 3 mm compared to 1.5 mm, respectively. On the underside of the insert, ribs 7 can be seen extending downwards. The ribs will for many embodiments extend far further downwards than illustrated in FIG. 1.

The insert is preferably located asymmetrical to the medial side in the softer elastic material with respect to a center of the softer elastic material, at least in the heel region of the midsole.

The specific dimensions, angles and locations are typical examples only, for a size 39 shoe. For other shoe sizes, the dimensions are adjusted linearly. For other embodiments, or for other foot problems, the twisting of the insert and the inclination of the top surface of the midsole and the dimensions and quantities of materials will be different, for example in opposite directions, or to a larger or smaller extent.

Figure 2:
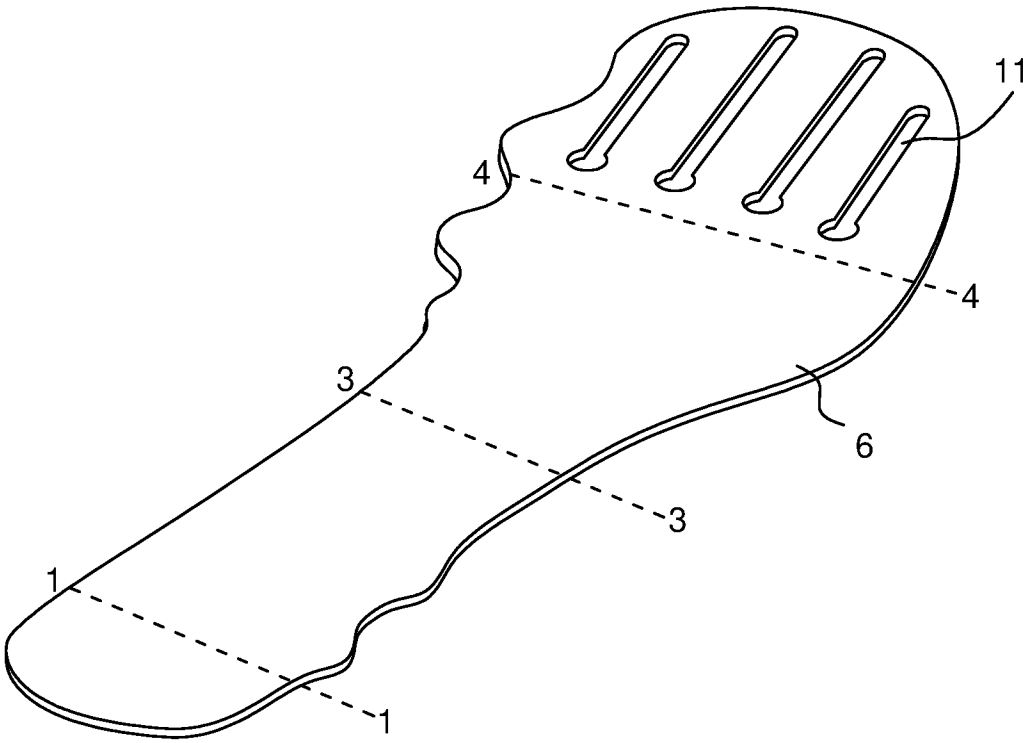
FIG. 2 illustrates an insert of a midsole of a shoe of the invention, in the form of a shank.

Further reference is made to FIG. 2, illustrating an insert 6, in the form of a shank 6, for embedding in a midsole in a shoe of the invention. The shank is twisted clockwise in the heel region and the midfoot region but is horizontal in the forefoot region of the shoe. This is easier seen in cross sections on FIGS. 1, 3 and 4, respectively, along the dashed lines 1-1, 3-3 and 4-4, respectively, of FIG. 2. Ribs 7 are visible only on said cross-sections. An insert of the invention, such as a shank, preferably comprises holes (not illustrated), as anchoring points for molding, and slots 11 in longitudinal direction in at least the forefoot area, for bending stiffness reduction and anchoring.

Figure 3:
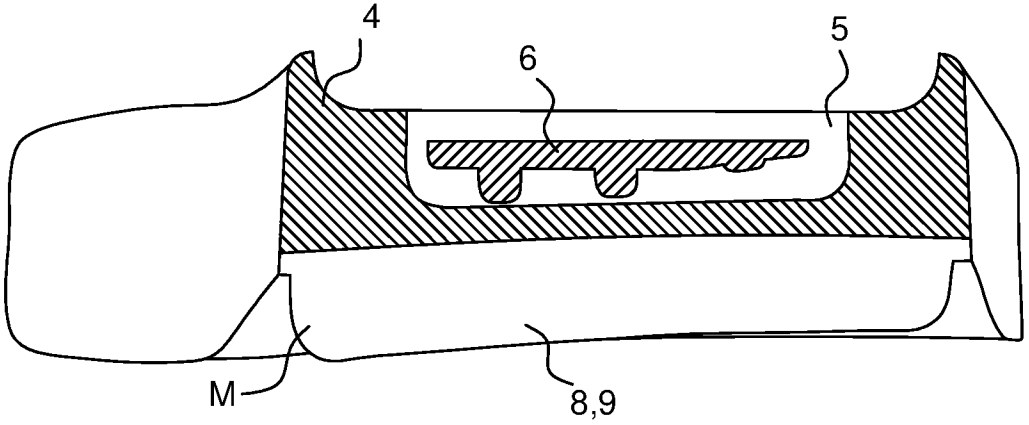
FIG. 3 is a medial-lateral cross section through the midfoot region of a shoe of the invention.

FIG. 3 illustrates a medial-lateral cross section through the midfoot region of a shoe of the invention. The shank, as well as the top surface of the midsole, are twisted clockwise, for a right shoe as seen from behind. The rubber outsole 9 has an archroller 8 integrated. On the medial side M, the archroller will touch the ground before the rest of the rubber outsole. The rubber outsole, and the integrated archroller, preferably has a hardness Shore A≥70, such as about 75, or Shore D≥30, such as about 35. The thickness of the softer elastic material 5 above the shank 6 is 0.6-2; 0.8-1.5; such as about 1 time the thickness of the shank excluding any ribs. The thickness of the softer elastic material 5 below the shank 6 is 0.6-2; 0.8-1.8; such as about 1.3 times the thickness of the shank excluding any ribs. The medial part of the shank is vertically above the medial part of the archroller. The softer and the harder elastic materials, constitute about 30-60%, or about 50% of the sole thickness. Accordingly, the elastic stiffness of the midsole in the midfoot area, particularly on the medial side, is relative higher than in the heel and forefoot areas of the sole, since more of the thickness is formed by the relative stiffer material rubber outsole/archroller and shank.

Figure 4:
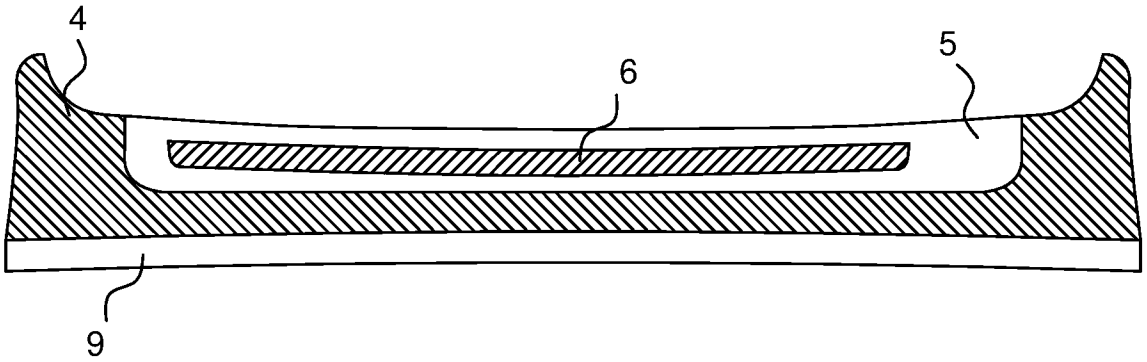
FIG. 4 is a medial-lateral cross section through the forefoot region of a shoe of the invention.

FIG. 4 illustrates a medial-lateral cross section through the forefoot region of a shoe of the invention. The thickness of the softer elastic material 5 above the shank 6 is 0.6-2; 0.7-1; such as about 0.8 times the thickness of the shank excluding any ribs. The thickness of the softer elastic material 5 below the shank 6 is 0.2-1.5; 0.3-1.2; such as about 0.5 times the thickness of the shank excluding any ribs. The sole in the forefoot is thinner, softer and with lower top surface compared to the midfoot part of the sole.

Figure 5:
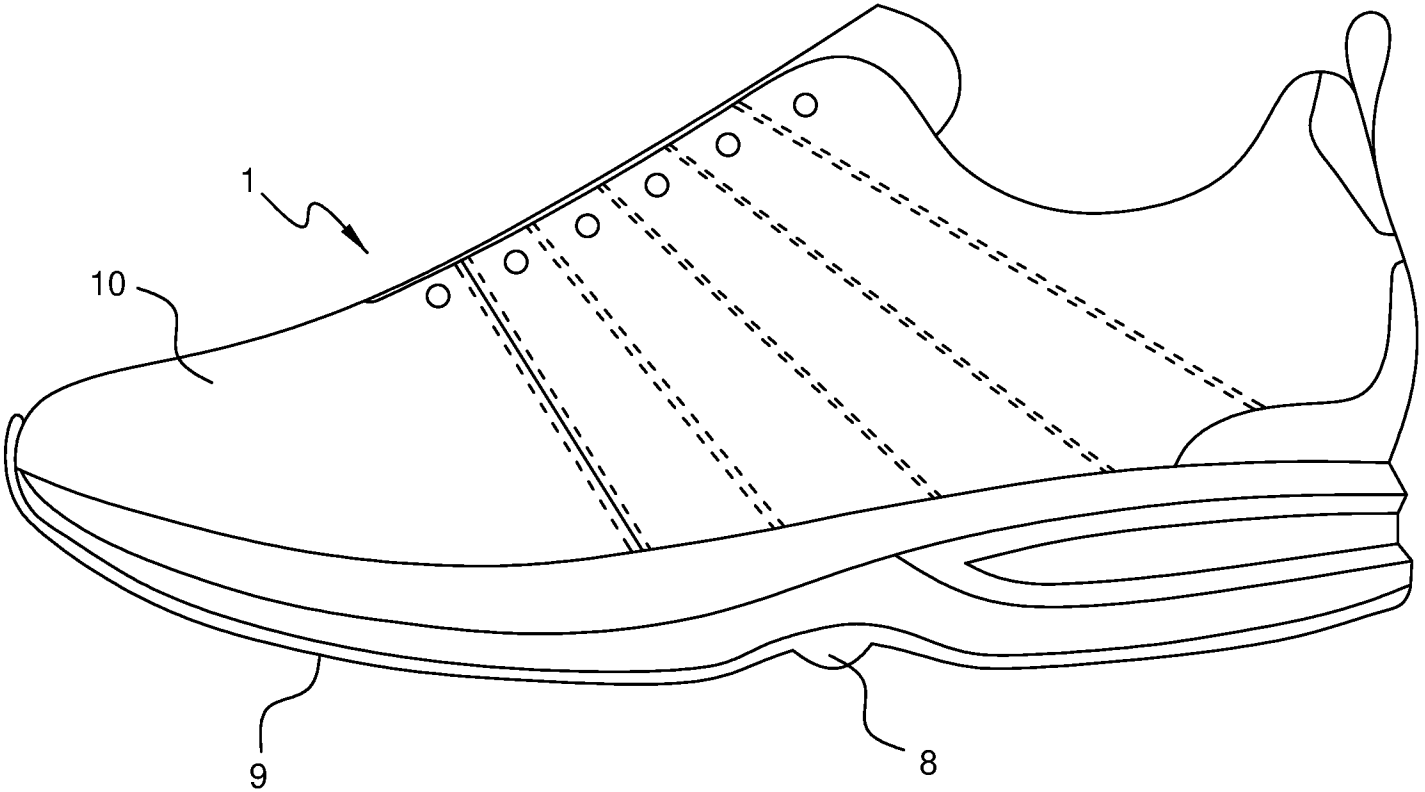
FIG. 5 illustrates a shoe of the invention.

FIG. 5 illustrates an embodiment of a complete shoe 1 of the invention, with rubber outsole 9, upper 10 and (not visible) insole, seen from the lateral side. The archroller 8, with the shoe standing unloaded on a flat rigid underlayer, will not reach the underlayer on the lateral side as illustrated, but will on the medial side. By studying FIG. 3, the skilled person may recognize that this is illustrated on FIG. 3. Typically, 2-6 cm, or preferably 3-5 cm of the medial part of the archroller, dependent on shoe size, is contacted by a flat underlayer by walking. In some embodiments of the shoe of the invention, the archroller is therefore not extending over the full length from medial to lateral of the sole, under the foot arch of the user.

The shoe 1 of the invention preferably comprises an archroller 8 and a shank 6, wherein the archroller preferably is integrated in the rubber outsole or arranged between the rubber outsole and the midsole or shank. The archroller is positioned in direction medial to lateral, directly under or slightly in front of the naviculare bone of a typical user with feet fitting the shoe size. Directly under or slightly in front of, in this context means from vertically below to 4 cm in front of the naviculare bone center. Measured along the sole, from heel to front, this corresponds to 30-50% or 35-45%, more precisely 38-40% of the length from heel to front.

The archroller 8 is a conical structure with respect to cross section dimension in vertical direction with the shoe as standing on a horizontal surface. The horizontal cross section dimension is in substance identical or decreasing along the length medial to lateral of the archroller. Alternatively, the vertical and/or horizontal archroller cross-section dimension is changed stepwise.

The archroller can be of massive rubber, at least on the medial side. The medial side of a shank, if present, is arranged over the medial side of the archroller.

Preferably, the archroller is integrated into the rubber outsole. Seen from the below or from the sides, the archroller, as integrated in the rubber outsole, extends further down on the medial side than on the lateral side, as seen in FIG. 3, which includes the archroller 8 in longitudinal section. A general convex curve in the longitudinal direction of the shoe undersole surface, is crossed by 1-5 mm by the archroller on the medial side and lacking 1-5 mm on the lateral side to reach said general curve. The cross dimension of the archroller in longitudinal direction of the shoe is in substance identical or is smaller on lateral side compared to medial side. The archroller, combined with the shank, provides a dynamic, progressive support for the user, in that more pronation provides more support, in that the archroller "lifts" the shank, actually reduce the sinking down of the shank over the archroller, whilst the shank bends down around the archroller in a curve providing comfortable support for the full length of the foot arch, the plantar aponeurosis. The shank must have an appropriate bending stiffness, which is provided by choosing a shank and sole as described. Thereby, so called "naviulare drop" is reduced or prevented. Also, plantar fasciitis, heelspur and similar problems will be reduced or prevented for most users.

«Naviculare drop» is biomechanical terminology meaning that the foot arch is extended and pressed down by the weight of the body of the user. Excessive naviculare drop is reduced or prevented by the present invention. Os naviculare lift or —lifter is alternative terminology describing the effect, meaning os naviculare lift as compared to the os naviculare drop of traditional walking shoes relative to the shoe of the invention.

On the medial side, the archroller reaches the floor before the general convex undersole surface curve when setting the shoe on a floor. The archroller 8 has larger vertical dimension, is higher, on the medial side than the lateral side of the shoe, reaching a flat floor before the general convex curve of the undersole surface.

The sole of the shoe of the invention has a soft elasticity at initial compression by the foot of the user, softer than a traditional walking shoe and similar to the initial softness of a sport shoe with extensive damping. At increasing compression, the elasticity becomes progressively harder, particularly on the medial side of heel and midfoot, and more expressed in the midfoot area than the heel area. The effect, when increasing the weight on the heelbone, is that the resistance to further compression is more expressed on the medial side compared to the lateral side. As a consequence, there is a dynamic progressive resistance against too much inward rotation of the heel bone (biomechanically defined as a "heel bone valgus rotation"). The torque creates a clockwise rotation for the right foot seen from behind, effecting the vertical orientation of the heelbone as well as the vertical alignment of the achilles tendon, compared to when using a traditional walking shoe or a sport shoe. Excessive heel bone valgus rotation is thereby reduced or prevented. Likewise, when progressing the step from heel impact to midfoot stance, the foot arch is supported by progressively harder elasticity in the midfoot area, under the foot arch and particularly under the medial side thereof, earlier (at less compression) and harder elasticity, providing "os naviculare lift". Preferably, the shoe comprises a combination of archroller and shank, whereby the archroller provides increasing force from the underlayer up on the shank at increasing compression, most on the medial side of the midfoot, whilst the shank bends and distribute the force along the foot arch.

The invention claimed is:

1. A shoe with a sole providing a dynamic heel support, the shoe comprising a rubber outsole, a midsole, the midsole comprising:

a harder elastic material;

a softer elastic material;

at least one insert having a higher elastic hardness than the harder elastic material and the softer elastic material, and a higher resistance against bending;

wherein the harder elastic material has elastic hardness in a range of 1.3 to 3 times higher than the softer elastic material;

wherein the harder elastic material is arranged in a band inside a periphery along sides and a heel of the midsole, the band extends inwards from the periphery, wherein the band, in the heel part of the midsole is wider on a medial side compared to a lateral side;

wherein the softer elastic material is arranged in the midsole inside the band of the harder elastic material;

wherein the at least one insert is arranged within the softer elastic material, at least in the heel part of the midsole; and wherein a thickness of the softer elastic material above the at least one insert in the heel part of the midsole is at least 0.5 times a thickness of the at least one insert and a thickness of the softer elastic material below the at least one insert in the heel part of the midsole is at least 1 times the thickness of the at least one insert as measured at a centreline of the at least one insert, excluding a thickness of ribs on the at least one insert.

2. The shoe according to claim 1, wherein the at least one insert is an inlay in the heel or the heel and intermediate part of the midsole, the inlay comprising at least one of the features as follows, in any combination:

at least 10% thicker on the medial side than the lateral sides;

at least 10% stiffer on the medial side than the lateral side;

twisted so as to be at higher elevation on the medial side than the lateral side; and arranged asymmetrical, to the medial side of the softer elastic material.

3. The shoe according to claim 1, wherein the at least one insert is a shank, the shank is embedded in an intermediate sole from the heel to a forefoot of the intermediate sole.

4. The shoe according to claim 1, wherein the at least one insert is a shank, the shank is adapted to support a user from the heel to an intermediate part to a position in front of a naviculare bone of the user, by being twisted in clockwise direction for a right foot midsole as seen from behind, the twisting is at an angle $\alpha 2$ in a range of 1° to 10° from horizontal.

5. The shoe according to claim 4, wherein $\alpha 2 \geq \alpha 1$.

6. The shoe according to claim 1, wherein the at least one insert is a shank, the shank is adapted to support a user from the heel to an intermediate part to a position in front of a naviculare bone of the user, by longitudinal ribs along an underside of the shank, the longitudinal ribs extending from the heel and the intermediate part to the position in front of the naviculare bone of the user, the longitudinal ribs are higher on a medial side of the than on a lateral side of the shank, at maximum extension the longitudinal ribs extend out from the shank underside of the shank at least a distance equal to a thickness of the shank without the longitudinal ribs.

7. The shoe according to claim 1, comprising:

an insert in the form of a shank of polymer material, wherein the polymer material comprises polyamide, wherein the polyamide comprises at least one of PA 6 and PA66, and the shank, exclusive of the ribs, is 0.5-5 mm thick and 20-45 mm wide in the heel area of the midsole.

8. The shoe according to claim 1, comprising:

a polyurethane as the harder elastic material; and wherein the polyurethane comprises at least one of polyurethane —PU— in a Shore A hardness range of 40-80, more preferably and polyurethane —PU— in a Shore A hardness of about 60.

9. The shoe according to claim 1, wherein the softer elastic material comprises polyurethane.

10. The shoe according to claim 9, wherein the polyurethane is polyurethane —PU— in a Shore A hardness range of 20-60.

11. The shoe according to claim 10, wherein the polyurethane is polyurethane —PU— in a Shore A hardness range of about 30.

12. The shoe according to claim 1, wherein at least a part of a top surface of the midsole is inclined, wherein the midsole is higher on the medial side than on the lateral side in the heel and intermediate part, the inclination is at an angle $\alpha 1$ in a range 1° to 7° from horizontal.

13. The shoe according to claim 12, wherein $\alpha 2 \geq \alpha 1$.

14. The shoe according to claim 1, wherein:

the shoe is adapted for running by increasing a thickness of the heel part of the sole.

15. The shoe of claim 1, wherein the band extends in a range of 0.1 to 1 times a midsole thickness inwards from the periphery.

16. A shoe with a sole providing a dynamic heel support, the shoe comprising a rubber outsole and a midsole, the midsole comprising:

a harder elastic material;

a softer elastic material;

at least one insert having a higher elastic hardness than the harder elastic material and the softer elastic material, and a higher resistance against bending;

wherein the harder elastic material has an elastic hardness in a range of 1.3 to 3 times higher than the softer elastic material;

wherein the harder elastic material is arranged in a band inside a periphery along a side and a heel of the midsole, the band extends inwards from the periphery, wherein the band, in the heel part of the midsole is wider on a medial side compared to a lateral side;

wherein the softer elastic material is arranged in the midsole inside the band of the harder elastic material;

wherein the at least one insert is arranged within the softer elastic material, at least in the heel part of the midsole;

wherein a thickness of the softer elastic material above the at least one insert in the heel part of the midsole is at least 0.5 times a thickness of the at least one insert and a thickness of the softer elastic material below the at least one insert in the heel part of the midsole is at least 1 times the thickness of the at least one insert as measured at a centreline of the at least one insert, excluding a thickness of ribs on the at least one insert;

wherein the shoe is adapted to fit a user suffering from diabetes, by:

adapting a horizontal dimension of the shoe to the user;

adapting a vertical dimension of the shoe to the user;

reducing at least one of a height and an elastic hardness of the sole adapted to fit under a toe ball of a first toe of the user; and reducing at least one of the height and the elastic hardness of the sole adapted to fit under the heel of the user.

17. A shoe with a sole providing a dynamic heel support, the shoe comprising a rubber outsole and a midsole, the midsole comprising:

a harder elastic material;

a softer elastic material;

at least one insert having a higher elastic hardness than the harder elastic material and the softer elastic material, and a higher resistance against bending;

wherein the harder elastic material has an elastic hardness in a range of 1.3 to 3 times higher than the softer elastic material;

wherein the harder elastic material is arranged in a band inside a periphery along sides and a heel of the midsole, the band extends in a range of 0.1 to 1 times a midsole thickness inwards from the periphery, wherein the band, in the heel part of the midsole is wider on a medial side compared to a lateral side;

wherein the softer elastic material is arranged in the midsole inside the band of the harder elastic material;

wherein the at least one insert is arranged within the softer elastic material, at least in the heel part of the midsole; and wherein a thickness of the softer elastic material above the at least one insert in the heel part of the midsole is at least 0.5 times a thickness of the at least one insert and a thickness of the softer elastic material below the at least one insert in the heel part of the midsole is at least 1 times the thickness of the at least one insert as measured at a centreline of the at least one insert, excluding a thickness of ribs on the at least one insert.

* * * * *